United States Patent [19]

Sakashita

[11] Patent Number: 5,010,801

[45] Date of Patent: Apr. 30, 1991

[54] ELECTRONIC MUSICAL INSTRUMENT WITH A TONE PARAMETER CONTROL FUNCTION

[75] Inventor: Shigeo Sakashita, Tokyo, Japan

[73] Assignee: Casio Computer Co., Ltd., Tokyo, Japan

[21] Appl. No.: 352,559

[22] Filed: May 16, 1989

[30] Foreign Application Priority Data

May 23, 1988 [JP] Japan ..... 63-67775[U]

[51] Int. Cl.[5] ..... G10H 1/053; G10H 1/06; G10H 1/18

[52] U.S. Cl. ..... 84/735; 84/737; 84/742

[58] Field of Search ..... 84/603, 723–746, 84/647, 653–670

[56] References Cited

U.S. PATENT DOCUMENTS 2,138,500 11/1938 Miessner .
2,301,184 11/1942 Arnold .
2,868,876 1/1959 Ticchioni .
3,429,976 2/1969 Tomcik .
3,439,106 4/1969 Goodale .
3,767,833 10/1973 Noble et al. .
3,938,419 2/1976 De Rosa .
4,193,332 3/1980 Richardson ..... 84/723 X
4,458,690 7/1984 O'Connor et al. .
4,580,479 4/1986 Bonanno .
4,765,219 8/1988 Alm .
4,805,510 2/1989 DeDianous .
4,864,625 9/1989 Hanzawa et al. ..... 84/603 X
4,915,008 4/1990 Sakashita .
4,919,032 4/1990 Sakashita .
4,939,975 7/1990 Sakashita .

FOREIGN PATENT DOCUMENTS 2598017 10/1987 France .
1537170 12/1978 United Kingdom .

*Primary Examiner*—Stanley J. Witkowski
*Attorney, Agent, or Firm*—Frishauf, Holtz, Goodman & Woodward

[57] ABSTRACT

An electronic musical instrument according to the present invention is applicable to musical instruments such as electronic wind instruments, electronic rubbed string instruments and electronic stringed instruments. Parameters of a musical tone to be generated are individually and independently altered and controlled in accordance with control data corresponding to a variation tendency of performance-input data which is detected by a performance input detection section and alters with time. And in accordance with a variation tendency per a predetermined period of time of breath operation intensity and/or lip operation intensity, parameters of the musical tone having a designated pitch are individually and independently altered and controlled.

20 Claims, 4 Drawing Sheets

ELECTRONIC MUSICAL INSTRUMENT WITH A TONE PARAMETER CONTROL FUNCTION

BACKGROUND OF THE INVENTION

The present invention relates to electronic musical instruments such as electronic wind instruments, electronic rubbed string instruments and electronic stringed instruments, and more particularly to electronic musical instruments capable of controlling parameters of a musical tone being produced in response to performance input operations such as breathing operation, lip operation and bow movement operation.

With a recent rapid development of electronic technology, there have been developed a wide variety of electronic musical instruments such as electronic wind instruments, electronic rubbed string instruments and electronic stringed instruments. In particular, electronic wind instruments are instruments capable of expressing musical tones in conformity with player's senses. In the electronic wind instruments, a breath sensor or a lip sensor provided on its mouthpiece portion translates breathing operation and lip operation of the player into electric signals, thereby allowing fine controls of sound volume and pitches of musical tones being electronically produced.

Such electronic wind instruments are described in, for example, U.S. Pat. No(s). 3,767,833, 2,138,500, 2,301,184, 2,868,876, 3,429,976, 3,938,419 and 3,439,106. In the electronic wind instruments of this type, tone-designating switches are disposed at a position where the player can easily put his fingers. The player designates one musical tone (musical interval) with a combination of a plurality of these depressed switches.

Further, in the electronic wind instruments, when breath intensity has become higher than a predetermined value, a musical tone having the designated pitch is output with volume corresponding to the breath intensity and the pitch of the musical tone is delicately changed in response to intensity of the lip operation.

When an acoustic wind instrument is actually played, however, tone color of a musical tone is different at beginning of browing and stopping of browing, even though the same quantity of breath supply is blown through the instrument. And even in case that a certain tone pitch is designated, slight deviations from the above tone pitch can be caused. Also in the acoustic instrument, when the breath intensity is gradually increasing at the beginning of blowing, breath leaking sounds and white noise sounds are caused.

However, in conventional electronic wind instruments, sound volume of musical tones is controlled only by the breath intensity, i.e., level or value of breath data and various parameters of a musical tone are not controlled so as to be affected by breath intensity varying with time. As described above, the conventional electronic wind instruments are incapable of reproducing with a high fidelity performance effects which are exhibited particularly by the above acoustic wind instruments.

The electronic rubbed string instruments and the electronic stringed instruments have defects similar to the mentioned above. For instance, the conventional electronic rubbed string instrument, as described in U.S. Pat. No. 4,765,219 and French Pat. No. FR 2,598,017, is capable of controlling volume of musical tones being produced in accordance with the speed of the bow movement but is incapable of controlling parameters (volume, tone color, effect) of a musical tone to be produced. Hence, this electronic rubbed string instrument, for instance, is not capable of increasing volume and adding vibrato effect at an upwards tendency in the speed of the bow movement and also is not capable of decreasing volume and adding a tremolo effect at a downwards tendency in the speed of the bow movement.

Similarly, the conventional electronic stringed instrument, as described in U.S. Pat. No(s). 4,458,690 and 4,580,479, is incapable of controlling parameters of a musical tone to be produced, which parameters are affected by varying-with-time tendencies of the speed of bow-movement operation and of the intensity of string plucking operation. Therefore, by playing these electronic musical instruments, it is impossible to obtain performance effects similar to those expressed by playing classic acoustic rubbed string instruments and classic acoustic stringed instruments.

SUMMARY OF THE INVENTION

The present invention has been intended to dissolve the above conventional disadvantages.

Therefore, it is an object of the present invention to provide an electronic musical instrument capable of obtaining performance effects similar to those expressed by playing classic acoustic musical instruments.

It is another object of the present invention to provide an electronic musical instrument capable of controlling musical tones by use of parameters different to each other in accordance with a varying-with-time tendency of performance input conditions.

Further, it is the other object of the present invention to provide an electronic musical instrument capable of controlling musical tones by use of parameters different to each other in accordance with a varying tendency per a predetermined time period of breathing operation and/or lip operation.

In case that the present invention is applied to an electronic musical instrument of a wind instrument type, there is provided an electronic musical instrument comprising:

breath detection means for detecting state of breath operation;

tendency detection means for detecting a variation tendency per a predetermined time period of breath operation force detected by said breath detection means;

output means for outputting control data different to each other, in accordance with the variation tendency detected by said tendency detection means;

pitch designation means for designating a pitch of a musical tone to be generated; and control means for individually and independently controlling and varying parameters of a musical tone having a pitch designated by said pitch designation means in accordance with control data output from said output means.

The term used above, "breath operation force", means intensity of breath blowing through the mouthpiece portion (a speed of breath air flow or a volume of breath air flow). The term, "variation tendency", means a tendency of a variation rate per a predetermined time period of the above breath operation force. The variation tendencies may be classified into three broad classes; an upward tendency of the breath operation force, a downward tendency of the breath operation force and a non-variation tendency of the breath operation force.

In case that in the similar manner, the present invention is applied to electronic musical instruments of the wind instrument type, there is provided an electronic musical instrument comprising:

lip detection means for detecting state of lip operation;

tendency detection means for detecting a variation tendency per a predetermined time period of lip operation force detected by said lip detection means;

output means for outputting control data different to each other, in accordance with the variation tendency detected by said tendency detection means;

pitch designation means for designating a pitch of a musical tone to be generated; and control means for individually and independently controlling and varying parameters of a musical tone having a pitch designated by said pitch designation means in accordance with control data output from said output means.

The term used above, "lip operation force", means intensity of biting or pressing with lips the mouthpiece portion of the instrument.

Further, the term, "parameters of a musical tone", means a pitch, tone color of a musical tone to be produced, and an effect and special effect sound to be added to a musical tone being produced.

One example of an electronic musical instrument of a wind instrument type, to which the present invention is applied will be described below.

In the electronic wind instrument according to the present invention, a musical tone is produced from musical tone generating means, which musical tone is controlled by the breath operation and operating pitch-designating switches or by the breath operation, the lip operation and operating pitch-designating switches.

The mouthpiece portion is provided, for example, at an upper portion of a pipe. A relevant tone pitch is designated by a combination of pitch designating switches or operating a particular pitch designating switch. The pitch designating switches are provided preferably on a portion of the above pipe, which allows a player to easily finger. A sensor means is provided, for example, inside the mouthpiece portion, which sensor means detects, as sense data, intensity of at least one of the breath operation and the lip operation on the mouthpiece portion.

A tone data generating means is provided, for example, inside the above pipe, which means generates tone data for controlling musical tones on the basis of the above sense data detected by the sensor means and varying with time lapse.

Further, a musical tone generating means is provided, for example, inside the above pipe, which musical tone generating means controls and generates on the basis of the above tone data a musical tone having a pitch designated by operating the tone designating switches.

In the above construction, the player of the instrument designates a pitch of a desired musical tone by operating the tone designating switches and starts a performance only by breath operation blowing his breath through the mouthpiece portion or by lip operation giving biting pressure to the mouthpiece portion as well as the above breath operation. When, for example, breath operation is performed at an intensity higher than a predetermined value, the musical tone generating means generates a musical tone having a pitch designated by switching operation of the tone designating switches.

At this time, the sensor means detects as sense data at least one of breath-operation intensity and lip-operation intensity and outputs the sense data to a tone data setting means.

The tone data generating means reads the above sense data, for example, at predetermined time intervals and produces, on the basis of variation state of the above sense data varying with time lapse, tone data for controlling musical tones, e.g., delicately changing pitch of a musical tone being produced by the musical tone generating means, outputting white noise sounds and adding a vibrato effect to the musical tone and sends the tone data to musical tone generating means.

On the basis of tone data delivered from the tone data generating means, the musical tone generating means, for example, delicately changes pitch of a musical tone being produced, outputs white noise sounds and adds a vibrato effect to the musical tone.

The tone data generating means generates the above tone data only when variation amount of the sense data sequentially read in becomes larger than a predetermined value, and furthermore, discriminates a variation state of the sense data varying with time lapse from more than three sense data sequentially read in at predetermined time intervals.

As mentioned above, in the electronic wind instrument according to the present invention, tone character can be controlled in accordance with variation state of the breath-operation intensity or the lip-operation intensity varying with time lapse and therefore white noise sounds together with the musical tone are output, pitch of the musical tone is delicately changed and a vibrato effect is added to the musical tone.

In the same way, in case that the present invention is applied to electronic stringed instruments and electronic rubbed string instruments, the similar performance effects are available.

The present invention is applicable not only to the above electronic musical instruments of the wind instrument type but also to electronic musical instruments of other type, such as electronic rubbed string instruments and electronic stringed instruments.

In case that the present invention is applied to electronic musical instruments of a type other than the above electronic musical instruments of a wind instrument type, there is provided an electronic musical instrument comprising:

performance-input detection means for detecting state of performance input;

detecting means for detecting a varying-with-time tendency of performance-input data detected by said performance-input detection means;

output means for outputting control data corresponding to the varying-with-time tendency detected by said detecting means; and control means for individually and independently controlling parameters of a musical tone to be generated in accordance with the control data output from said output means.

The term, "state of performance input," means state of rotating operation of a tremolo arm used in electronic stringed instruments, state of pitch bend operation of strings, state of plucking operation of strings and state of bow operation applied to electronic rubbed string instruments.

EMBODIMENTS

An embodiment of the present invention will be described in detail hereinafter.

Construction

Figure 1:
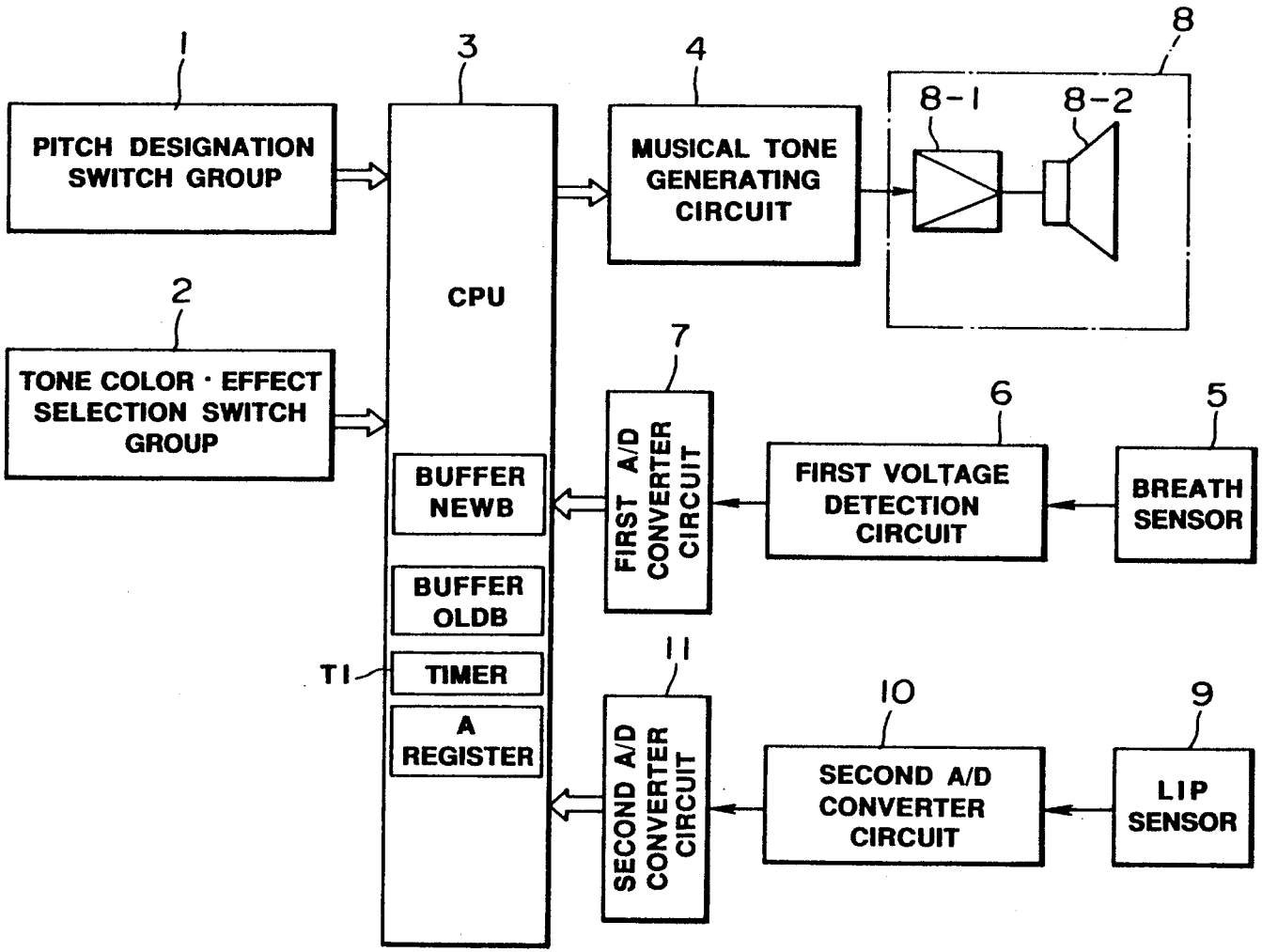
FIG. 1 is a block diagram showing a system construction of one embodiment of an electronic wind instrument according to the present invention.

FIG. 1 is a block diagram of a system construction of an embodiment of an electronic wind instrument according to the present invention. A pitch-designation switch group 1 comprises a plurality of switches for designating pitch of a tone to be generated. Each of tones is designated by a combination of depressed switches (turned-on switches).

Tone color-effect selection switch group 2 serves for electing tone color of a musical tone and for deciding whether or not various effects are added to a musical tone.

CPU (Central Processing Unit) 3 comprises, for example, a microprocessor, which reads state (turned-on/turned off) of each switch of the pitch designation switch group 1 at predetermined time intervals and discriminates pitch designated by the tone designation switch group 1 from the above state data. When another pitch has been designated, the CPU 3 outputs to a musical tone generating circuit 4 tone data for generating a musical tone having a pitch currently designated.

Further, the CPU 3 reads state of each switch of the tone color-effect selection switch group 2 at predetermined time intervals and decides an effect to be added to the designated tone color or musical tone in accordance with the above state data of the switch group 2. The CPU 3 further outputs color data for generating the designated tone color to the musical tone generating circuit 4 and stores kinds of the effect to be added to the musical tone at a memory area (not shown) in the CPU 3.

A breath sensor 5 serves to sense intensity of breath blowing through a mouthpiece portion of the electronic wind instrument. The sense-data of the breath sensor is converted into a voltage corresponding to the sense-data by a first voltage detection circuit 6 and is applied to a first A/D converter circuit 7. The first A/D converter circuit 7 converts the applied voltage to, for example, 8-bit digital breath data and supplies the data to CPU 3. On the basis of the value of the digital breath data delivered from the first A/D converter circuit 7, CPU 3 decides timings at which a key-on data for starting tone generation and a key-off data for stopping tone generation are output to the musical tone generating circuit 4. Further, CPU 3 produces sound volume data which designate a sound-volume level of a musical tone to be generated at the time of key-on and thereafter and outputs the sound volume data to the musical tone generating circuit 4.

As will be described in detail later, CPU 3 discriminates whether intensity of breath blowing through the mouthpiece is gradually increasing or decreasing on the basis of variation in the digital breath data sequentially inputted from the first A/D converter circuit 7 and outputs to the musical tone generating circuit 4 control data (data for controlling to add a vibrato effect, for controlling pitch of a musical tone and for controlling to output white noise sounds) of a musical tone.

The musical tone generating circuit 4 serves to generate a musical tone having a pitch designated by the pitch designation switch group 1 with tone color and an effect designated by the tone color-effect selection switch group 2. Receiving key-on data from CPU 3, the musical tone generating circuit 4 starts generating of the relevant musical tone at the timing. When tone control data based upon breath operation is applied from CPU 3 to the musical tone generating circuit 4, the above circuit 4 adds a vibrato effect to the musical tone being generated, outputs white noise sounds together with the musical tone and changes pitch of the musical tone.

The musical tone and white noise sounds generated by the musical tone generating circuit 4 are supplied to a musical tone output section 8. The musical tone output section 8 consists of an amplifier 8-1 and a speaker 8-2, and outputs audibly the musical tone and white noise sounds delivered from the musical tone generating circuit 4.

A lip sensor 9 serves to sense intensity of biting pressure on the mouthpiece portion. The sense data of the lip sensor 9 is converted to a voltage corresponding to the sense-data by a second voltage detection circuit 10 and then is applied to a second A/D converter circuit 11.

The second A/D converter circuit 11 converts the voltage delivered from the second voltage detection circuit 10 into digital lip data and supplies the data to CPU 3.

Figure 2B:
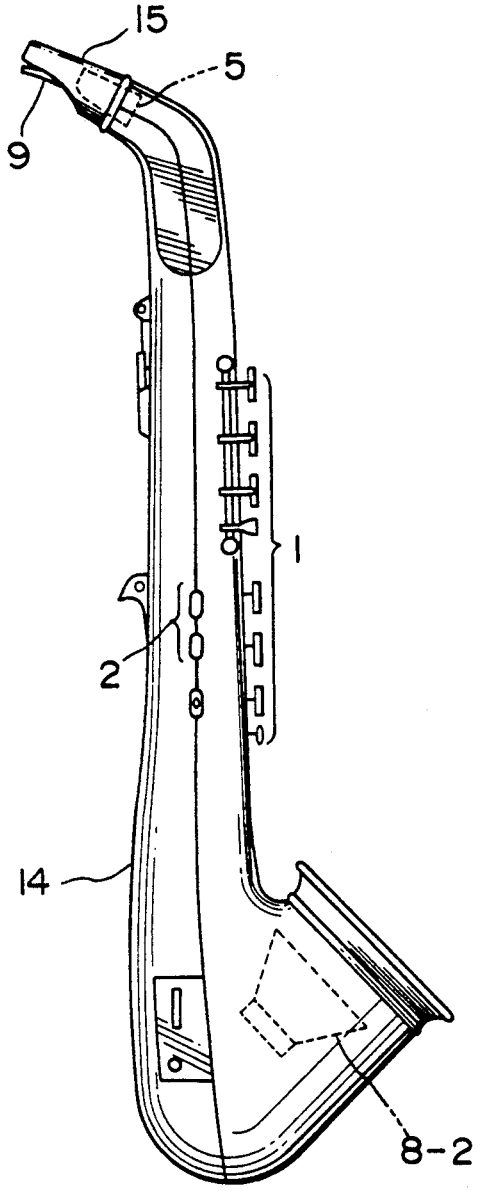
FIG. 2B is a front view of the embodiment of the electronic wind instrument according to the present invention.
Figure 2A:
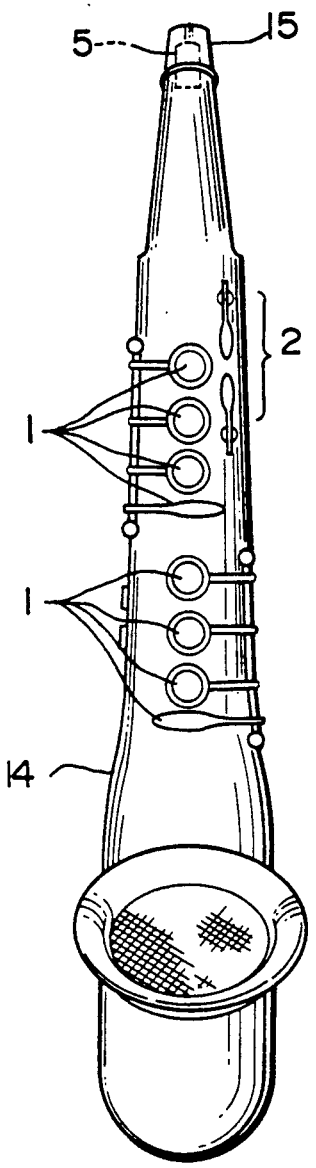
FIG. 2A is a left side view of the embodiment of the electronic wind instrument according to the present invention.

FIGS. 2A and 2B are external views of the electronic wind instrument embodying the embodiment of FIG. 1. As shown in FIGS. 2A and 2B, the present invention has a shape of a wind instrument consisting of a pipe portion 14 and a mouthpiece portion 15. The pitch designation switch group 1 and the tone color. effect selection switch group 2 each are disposed at place on the pipe portion 14 where a player can easily finger the switches.

A lip sensor 9 of FIG. 1 is provided at a place on the mouthpiece portion 15 where the player can easily put his lips. The breath sensor 5 is disposed in the vicinity of the portion jointing the mouthpiece portion 15 and the pipe portion 14.

Composing elements other than those shown in FIG. 1 are mounted inside the pipe portion 14 of FIG. 2.

Operation of the embodiment illustrated in FIGS. 1, 2A and 2B will be described hereinafter. With respect to those no further described, their description in FIGS. 1, 2A and 2B should be referred to.

In the first place, the operation of the embodiment of the invention will be described in brief.

At first, the player of the instrument operates the tone color effect selection switch group 2. The CPU 3 watches operation of the tone color effect selection switch group 2 at predetermined time intervals under control of a certain programme (not shown). Detecting alteration in setting state of the tone color-effect selection switch group 2, CPU 3 outputs data designated by switch operation to the musical tone generating circuit 4. Then, the musical tone generating circuit 4 generates a musical tone having the designated tone color and alters its state so as to add the designated effect to the musical tone.

Next, the player blows his breath through the mouthpiece portion 15 to start a performance, fingering the pitch designation switch group 1 to designate pitches. At this time, CPU 3 watches the operation state of the pitch designation switch group 1 at predetermined time intervals. When alteration in setting state of the pitch designation switch group 1 has been detected, CPU 3 outputs the data to the musical tone generating circuit 4, and thereby the musical tone generating circuit 4 sets the pitch (the musical scale) so as to generate a musical tone having the designated pitch.

On the other hand, intensity of breath blowing through the mouthpiece portion 15 is sensed by the breath sensor 5 and is delivered as digital breath data through the first A/D converter circuit 7 to CPU 3. When the digital breath data exceeds a predetermined value, i.e., when player blows through the mouthpiece portion 15 with intensity higher than a certain value, CPU 3 outputs key-on data to the musical tone generating circuit 4 and thereby the musical tone generating circuit 4 starts generating a musical tone having the tone color and the pitch designated by the above operation. Inversely, when the player stops blowing through the mouthpiece portion 15 and the above breath data becomes smaller than a predetermined value, CPU 3 outputs key-off data to the musical tone generating circuit 4 and thereby the musical tone generating circuit 4 stops generating a musical tone.

As described above, the musical tone generating circuit 4 generates a musical tone having the pitch designated by the pitch designation switch group 1. But in the present embodiment, CPU 3 discriminates variation in intensity of breath blowing through the mouthpiece portion 15 from variation value in the breath data sequentially read therein and produces musical tone data for altering pitch, adding a vibrato effect and generating white noise sounds in response to the gradually increasing blowing intensity at starting of blowing and the gradually decreasing blowing intensity at stopping of blowing and then delivers the musical tone data to the musical tone generating circuit 4.

Figure 3:
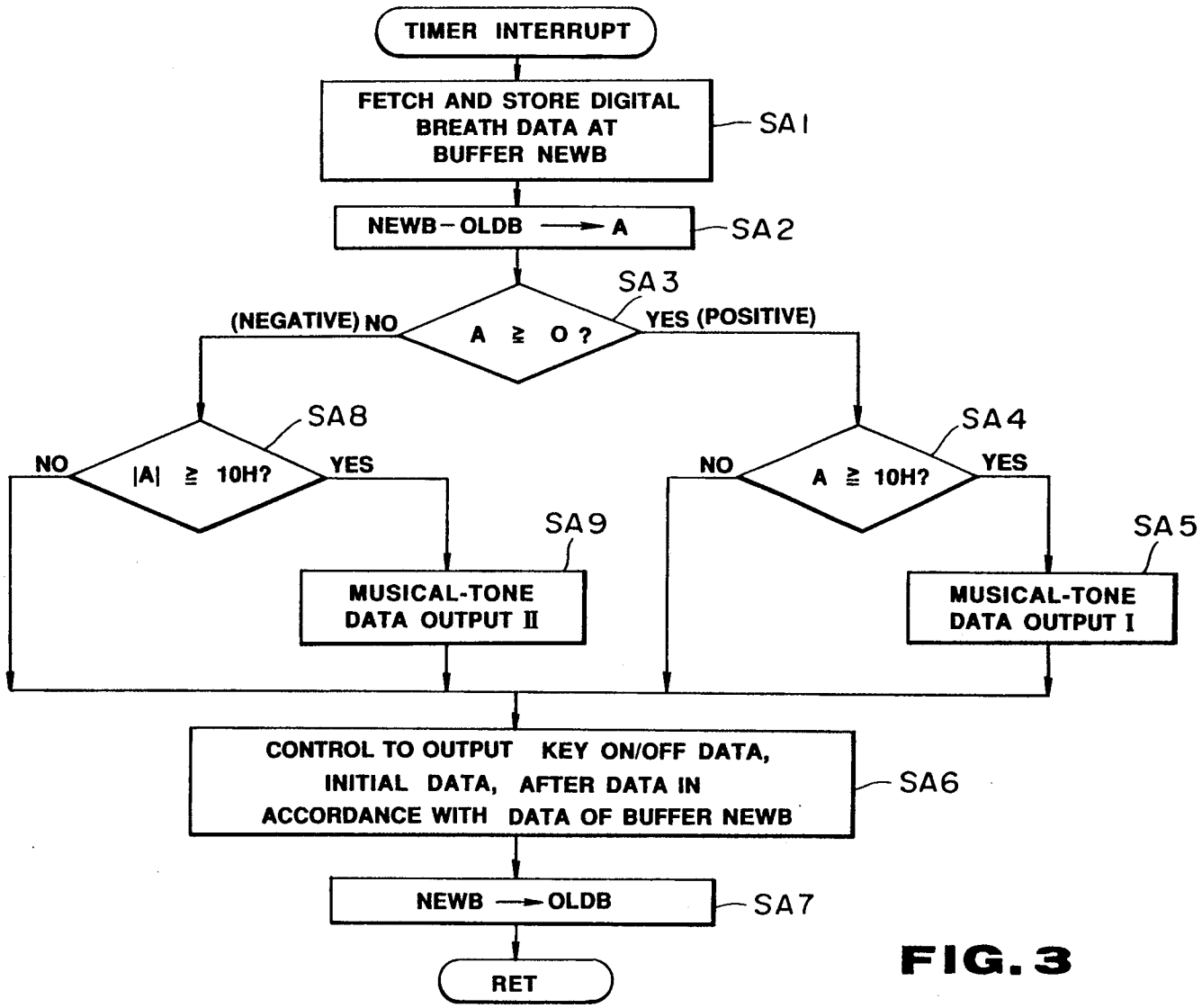
FIG. 3 is a flow chart of operation to be executed when breath operation is performed in a first embodiment.

FIG. 3 illustrates a flow chart of operation which CPU 3 of the first embodiment executes when breath operation is performed. Buffers NEWB and OLDB shown in the flow chart of FIG. 3 are buffers for storing the current breath data and the preceding breath data, respectively (FIG. 1).

CPU 3 starts its operation in accordance with the flow chart of FIG. 3, when an interruption is caused by a timer TI enclosed in CPU 3.

When the timer interruption is caused, CPU 3 fetches the breath data through the first A/D converter circuit 7 and stores the breath data at the buffer NEWB (SA1).

Then CPU 3 subtracts the breath data previously fetched and stored at the buffer OLDB from the breath data stored at the buffe NEWB and stores the result of the subtraction at an A register (SA2).

Next, it is discriminated whether the result of the subtraction stored at the A register is positive or negative (SA3). If the result of the subtraction is positive, which means that the value of the breath data is increasing, then it is further discriminated whether or not the result of the subtraction i.e., an increasing value is larger than or equal to a value "10H" (H stands for a hexadecimal number) (SA4). If the increasing value is larger than or equal to 10H, the pitch data which has been set to the musical tone generating circuit 4 is increased by 3 cents and the musical tone data for outputing white noise sounds is applied to the musical tone generating circuit 4. Further, if a vibrato effect is being currently added to the musical tone by the musical tone generating circuit 4, CPU 3 outputs to the musical tone generating circuit 4 musical tone data for stopping adding the vibrato effect to the musical tone (SA5).

In this manner, if the increasing value of breath data is larger than or equal to 10H, pitch data is increased by 3 cents and at the same time, musical tone data for outputing white noise sounds is set to the musical tone generating circuit 4. If the vibrato effect is being added to the musical tone, musical tone data for stopping addition of the vibrato effect to the musical tone is set to the musical tone generating circuit 4. As the result, pitch of the musical tone is made higher by 3 cents and white noise sounds are output. And if a vibrato effect is added to the musical tone, the vibrato effect is ceased.

Furthermore, CPU 3 outputs to the musical tone generating circuit 4 key ON data, key OFF data, initial data and after data in accordance with the value of breath data stored at the buffer NEWB (SA6).

The above will be described in further detail. If the value of the above breath data is larger than or equal to a predetermined value (a threshold value of key-ON starting) while the musical tone generating circuit 4 is idle and is not generating a musical tone, CPU 3 supplies sound volume data (initial data) for designating a predetermined sound volume as well as key ON data to the musical tone generating circuit 4. As the result, the musical tone generating circuit 4 starts generating sound of a musical tone with sound volume corresponding to the above sound volume data (initial data).

Meanwhile, if the above breath data is larger than or equal to the threshold value of key ON starting while the musical tone generating circuit 4 is generating a musical tone, CPU 3 produces sound volume data (after data) corresponding to the above breath data and supplies it to the musical tone generating circuit 4. Hence, the musical tone generating circuit 4 produces sound of musical tone with sound volume corresponding to the above sound volume data (after data).

If the above breath data is smaller than the threshold value of key ON starting and the musical tone generating circuit 4 is generating sound of a musical tone, CPU 3 applies key OFF data to the musical tone generating circuit 4. As the result, the musical tone generating circuit 4 stops sounding.

Then, CPU 3 transfers the breath data stored at the buffer NEWB to the buffer OLDB (SA7).

In the meantime, if it is decided at SA3 that the result of the subtraction of breath data stored at the register A is negative, i.e., if the breath data is decreasing, it is discriminated whether or not the result of the subtraction (the decreasing value) is larger than or equal to "10H" (SA8). And if the decreasing value of breath data is larger than or equal to "10H", CPU 3 decreases pitch data set in the musical tone generating circuit 4 by 3 cents and if white noise sounds are being generated, CPU 3 applies musical tone data for stopping outputting white noise sounds to the musical tone generating circuit 4. And if a vibrato effect is not added to a musical tone, CPU 3 supplies musical tone data for adding a vibrato effect to the musical tone to the musical tone generating circuit 4 (SA9).

As the result, the pitch of the musical tone generated by the musical tone generating circuit 4 is decreased by 3 cents and if white noise sounds have been produced, then generation of the white noise sounds is stopped. If the vibrato effect has not been added to a musical tone, the vibrato effect is added to the musical tone.

Following the operation at SA9, operations at SA6 and SA7 are executed. Then CPU 3 outputs to the musical tone generating circuit 4 key ON data, key OFF data, initial data and after data in accordance with breath data.

When intensity of the player's breath blowing through the mouthpiece portion 15 is gradually increasing, the pitch of the musical tone is made higher by 3 cents than that designated by switching operation of the pitch designation switch group 1 and white noise sounds are output. Accordingly, when intensity of breath is extremely high as at the beginning of blowing, a musical tone having a pitch is produced which pitch is somewhat higher than that designated by the player, and white noise sounds are output, so that even at the beginning of blowing, a performance effect similar to that given by acoustic wind instruments is realized with a high fidelity.

Figure 4:
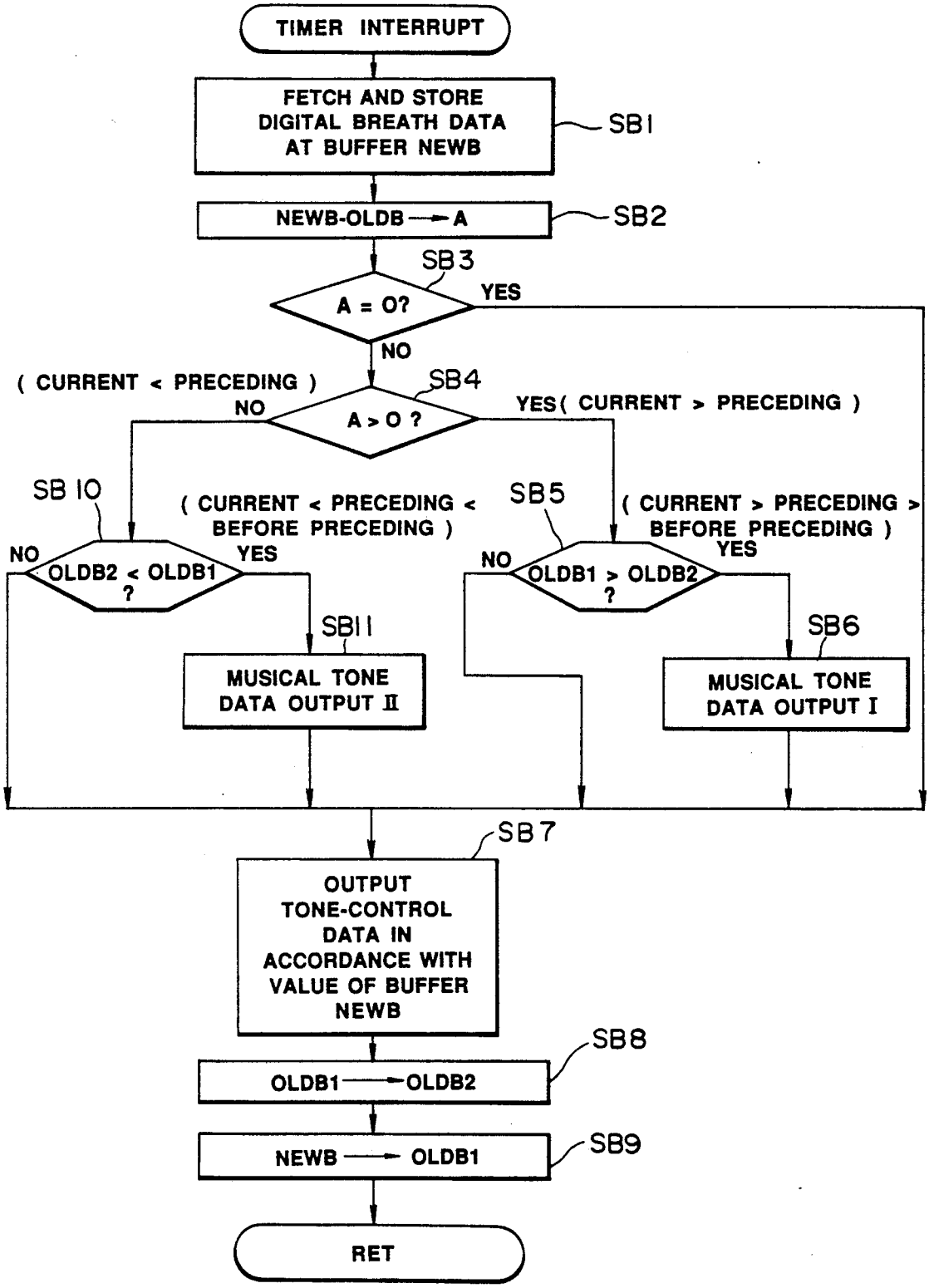
FIG. 4 is a flow chart of operation to be executed when breath operation is performed in a second embodiment.

FIG. 4 is a flow chart of operation executed when breath operation is performed in the second embodiment of the present invention. Buffers NEWB, OLDB1 and OLDB2 (not shown in the flow chart of FIG. 4) serve for storing the current breath data, for storing the preceding breath data and for storing the breath data fetched before the preceding data, respectively.

When a timer interruption is caused, CPU 3 executes similar processings to those at SA1 and SA2 of the first embodiment (SB1, SB2) and stores at the A-register the result of the subtraction of the previously fetched breath data from the currently fetched breath data.

Then, it is discriminated whether the result of the subtraction stored at the A-register is equal to "0" or not (SB3).

If the subtraction result stored at the A-register is not equal to "0", i.e., if the current breath data is changed from the preceding breath data, it is discriminated whether the above subtraction result is positive or not (SB4).

When the above subtraction result is positive, i.e., when the current breath data is larger than the preceding breath data, it is discriminated whether or not the preceding breath data stored at the buffer OLDB1 is larger than the breath data fetched before the preceding breath data stored at the buffer OLDB2 (SB5).

If the preceding breath data is larger than the breath data fetched before the preceding data, then the breath data are large in order of the data fetched before the preceding data, the preceding data and the current data. Hence, it is decided that intensity of breath blowing through the mouthpiece is gradually increasing and CPU 3 executes a processing similar to that at SA5 of the first embodiment shown in FIG. 3 and increases pitch of a musical tone by 3 cents and outputs white noise sounds (SB6).

Further, CPU 3 executes a processing similar to that at SA6 of the first embodiment and outputs to the musical tone generating circuit 4 musical tone control data such as key ON data, key OFF data, initial data and after data (SB7).

CPU 3 transfers the preceding breath data stored at the buffer OLDB1 to the buffer OLDB2 (SB8) and transfers the current breath data stored at the buffer NEWB to the buffer OLDB1 (SB9).

Meanwhile, if it is decided at the above SB5 that the preceding breath data stored at the buffer OLDB1 is smaller than the breath data fetched before the preceding data, the processings at SB7 through SB9 are executed.

That is, in the second embodiment, breath data are sequentially fetched for three times at predetermined time intervals (every generation of timer interruptions). If the data fetched for the third time is larger than that fetched for the second time and the data fetched for the third time is larger than that fetched for the first time, then it may be decided that the intensity of breath blowing through the mouthpiece portion 15 is gradually increasing.

If the result of the subtract stored at A-register at SB4 is negative, it is discriminated whether or not the preceding breath data stored at the buffer OLDB1 is smaller than the breath data fetched before the preceding breath data, stored at the buffer OLDB2 (SB10).

When the preceding breath data is smaller than the breath data fetched before the preceding data, then CPU 3 executes the processing similar to that at SA9 of the first embodiment, that is, CPU 3 decreases pitch of the musical tone by 3 cents, adds a vibrato effect to the musical tone and stops generating of white noise sounds (SB11).

As described above, in the second embodiment, breath data are sequentially fetched for three times at predetermined time intervals (time intervals of generation of timer). If each breath data is smaller than its preceding breath data, it is decided that the intensity of breath blowing through the mouthpiece portion 15 is gradually decreasing.

When it is decided at SB10 that the preceding data is larger than the breath data fetched before the preceding data, or after termination of the processing of the above SB11, CPU 3 executes processings of the above SB7 through SB9.

If the result of the subtract stored at A-register at SB3 is equal to "0", then it may be decided that the intensity of breath blowing through the mouthpiece portion 15 is kept constant and CPU 3 executes processings of SB7 through SB9.

In the first and second embodiments, it is decided regardless of the value of the current breath data that the intensity of the breath blowing through the mouthpiece portion is increasing (or decreasing). However, it may be decided that the intensity of the breath blowing through the mouthpiece portion is increasing, only when the current breath data exceeds a predetermined value (for example, "3FH"), and also it may be decided that the intensity of breath blowing through the mouthpiece portion is decreasing, only when the current breath data is smaller than or equal to a predetermined value (for example, "6FH"). In this manner, it can be precisely decided whether blowing through the mouthpiece portion is started or stopped.

In the above first and second embodiments, characters of a musical tone are controlled on the basis of breath data produced by breath operation, but in the same manner, characters of a musical tone can be also controlled on the basis of lip data produced by lip operation.

The character control of a musical tone is not limited to the above embodiments, but other various controls such as adding a tremolo effect, flanging, phasing and compressing are available.

Further, in the above first and second embodiments, the electronic wind instrument to which the present invention is applied has been described. However, it will be easily understood that the present invention can be applied to other electronic musical instruments such as, for example, an electronic rubbed string instrument and an electronic stringed instrument. In electronic musical instruments to which the present invention is to be applied, the control system can be arranged such that control data are produced which correspond to a varying-with-time tendency of data detected by a performance-input detecting means such as a bow-operation speed detecting section and a tremolo-arm operation speed detecting section and on the basis of the control data parameters (tone color and sound volume) of a musical tone to be generated are controlled individually and independently.

What is claimed is;

1. An electronic musical instrument comprising:

breath detection means for detecting a state of breath operation performed by a player;

instruction means for giving an instruction to start generation of a musical tone in response to breath operation force detected by said breath detection means when said breath operation force exceeds a predetermined value;

tendency detection means for judging if a variation in breath operation force during a predetermined time period detected by said breath detection means exhibits a tendency to increase or a tendency to decrease after a musical tone has been generated in accordance with the instruction from said instruction means;

output means for outputting first control data when said tendency detection means judges that the variation in the breath operation force exhibits a tendency to increase and meanwhile for outputting second control data when said tendency detection means judges that the variation in the breath operation force exhibits a tendency to decrease; and control means for controlling parameters of said musical tone in accordance with the first control data, when said output means outputs the first control data while the musical tone is being generated in accordance with the instruction from said instruction means and for controlling at the same time so as to start generation of a sound of a particular effect, and for controlling parameters of said musical tone in accordance with the second control data in a different manner from that in accordance with the first control data, when said output means outputs the second control data while the musical tone is being generated in accordance with the instruction from said instruction means and for controlling at the same time so as to stop generation of the sound of a particular effect.

2. An electronic musical instrument in accordance with claim 1, wherein the parameters of the musical tone generated in accordance with the instruction from said instruction means comprises pitch parameters and the sound of a particular effect comprises white noise sounds.

3. An electronic musical instrument in accordance with claim 1, wherein said breath detection means comprises breath-sensor means for detecting state of breath operation.

4. An electronic musical instrument in accordance with claim 1, further comprising musical-tone generating means for generating the musical tone in accordance with an instruction of said instruction means.

5. An electronic musical instrument in accordance with claim 4, wherein said musical-tone generating means are mounted on a body of the musical instrument.

6. An electronic musical instrument, comprising:

performance-input detection means for detecting a state of performance input by a player;

instruction means for giving an instruction to start generation of a musical tone in response to performance input force detected by said performance-input detection means when said performance-input force exceeds a predetermined value;

tendency detection means for judging if a variation in performance-input force during a predetermined time period detected by said performance-input detection means exhibits a tendency to increase or a tendency to decrease after a musical tone has been generated in accordance with the instruction from said instruction means;

output means for outputting first control data when said tendency detection means judges that the variation in the performance-input force during a predetermined time period exhibits a tendency to increase and meanwhile for outputting second control data when said tendency detection means judges that the variation in the performance-input force during a predetermined time period exhibits a tendency to decrease; and control means for controlling parameters of said musical tone in accordance with the first control data, when said output means outputs the first control data while the musical tone is being generated in accordance with the instruction from said instruction means and for controlling at the same time so as to start generation of a sound of a particular effect, and for controlling parameters of the above musical tone in accordance with the second control data in a different manner from that in accordance with the first control data, when said output means outputs the second control data while the musical tone is being generated in accordance with the instruction from said instruction means and for controlling at the same time so as to stop generation of the sound of a particular effect.

7. An electronic musical instrument in accordance with claim 6, wherein the parameters of the musical tone generated in accordance with the instruction from said instruction means comprises pitch parameters and the sound of a particular effect comprises white noise sounds.

8. An electronic musical instrument in accordance with claim 6, wherein said performance-input data detected by said performance-input detection means is used for designating a pitch of a musical tone to be generated, said first control data output from said data-output means is used for altering the pitch designated by said performance input data to a higher pitch and also for outputting particular effect sounds and said second control data output from said data-output means is used for altering the pitch designated by said performance input data to a lower pitch and also for stopping generating of particular effect sounds.

9. An electronic musical instrument in accordance with claim 6, wherein said performance-input data detected by said performance-input detection means is used for designating a pitch of a musical tone to be generated, said first control data output from said data-output means is used for altering the pitch designated by said performance-input data to a higher pitch and also for outputting first particular effect sounds and said second control data output from said data-output means is used for altering the pitch designated by said performance-input data to a lower pitch and also for stopping generating of particular effect sounds.

10. An electronic musical instrument in accordance with claims 6, wherein said output means comprises:

converter means for converting performance-input data into a relevant digital value, said performance-input data detected by said performance-input detection means; and data-output means for detecting at predetermined time lapses digital values output from said converter means, and for outputting said first control data when the digital value shows a tendency to increase and for outputting said second control data when the digital value shows a tendency to decrease.

11. An electronic musical instrument comprising:

pitch designation means for designating a pitch of a musical tone to be generated;

breath detection means for detecting state of breath operation performed by a player;

instruction means for giving an instruction to start generation of a musical tone in response to breath operation force detected by said breath detection means when said breath operation force exceeds a predetermined value;

tendency detection means for judging if a variation in breath operation force during a predetermined time period detected by said breath detection means exhibits a tendency to increase or a tendency to decrease after a musical tone has been generated in accordance with the instruction from said instruction means;

output means for outputting first control data when said tendency detection means judges that the variation in the breath operation force exhibits a tendency to increase, and for outputting second control data when said tendency detection means judges that the variation in the breath operation force exhibits a tendency to decrease; and control means for controlling parameters of the generated musical tone of a pitch designated by said pitch designation means in accordance with the first control data and for controlling at the same time so as to start generation of a sound of a particular effect, and for controlling parameters of said musical tone in accordance with the second control data in a different manner from that in accordance with the first control data, when said output means outputs the second control data while the musical tone is being generated in accordance with the instruction from said instruction means and for controlling at the same time so as to stop generation of the sound of a particular effect.

12. An electronic musical instrument in accordance with claim 11, wherein the parameters of the musical tone generated in accordance with the instruction from said instruction means comprises pitch parameters and the sound of a particular effect comprises white noise sounds.

13. An electronic musical instrument in accordance with claim 11, wherein said breath detection means comprises breath sensor means for detecting state of breath operation.

14. An electronic musical instrument in accordance with claim 11, wherein the first control data supplied from said data-output means is used for altering the pitch designated by said pitch designation means to a higher pitch and for outputting particular effect sounds and second control data supplied from said data-output means is used for altering the pitch designated by said designation means to a lower pitch and for generating particular effect sounds effect sounds and the second control data supplied from said output means is used for altering the pitch designated by said pitch designation means to a lower pitch and for outputting second particular effect sounds.

15. An electronic musical instrument in accordance with claim 11, wherein said pitch designation means is mounted on a body of the musical instrument.

16. An electronic musical instrument comprising:

pitch designation means for designating a pitch of a musical tone to be generated;

performance-input detection means for detecting state of performance input by a player;

instruction means for giving an instruction to start generation of a musical tone in response to performance input force detected by said performance-input detection means when said performance-input force exceeds a predetermined value;

tendency detection means for judging if a variation in performance-input force during a predetermined time period detected by said performance-input detection means exhibits a tendency to increase or a tendency to decrease after a musical tone has been generated in accordance with the instruction from said instruction means;

output means for outputting first control data when said tendency detection means judges that the variation in the performance-input force during a predetermined time period exhibits a tendency to increase, and for outputting second control data when said tendency detection means judges that the variation in the performance-input force during a predetermined time period exhibits a tendency decrease; and control means for controlling parameters of the generated musical tone of a pitch designated by said pitch designation means in accordance with the first control data and for controlling at the same time so as to start generation of a sound of a particular effect, and for controlling parameters of said musical tone in accordance with the second control data in a different manner from that in accordance with the first control data, when said output means outputs the second control data while the musical tone is being generated in accordance with the instruction from said instruction means and for controlling at the same time so as to stop generation of the sound of a particular effect.

17. An electronic musical instrument in accordance with claim 16, wherein the parameters of the musical tone generated in accordance with the instruction from said instruction means comprises pitch paratmeters and the sound of a particular effect comprises white noise sounds.

18. An electronic musical instrument in accordance with claim 16, wherein said output means comprises:

converter means for converting performance input data detected by said performance-input detection means into relevant digital values;

digital value detection means for detecting, at predetermined time lapses, digital values supplied from said converter means;

discrimination means for sequentially reading digital values detected by said digital value detection means for at least three times, and for discriminating whether the read digital value is showing a tendency to increase or a tendency to decrease; and data output means for outputting said first control data and said second control data in accordance with the discrimination result by said discrimination means, said first control data indicating that said digital data shows a tendency to increase and said second control data indicating that said digital data shows a tendency to decrease.

19. An electronic musical instrument in accordance with claim 16, wherein said output means comprises:

converter means for converting performance-input data detected by said performance-input detection means into relevant digital values;

digital value detection means for detecting at predetermined time lapses digital values supplied from said converter means;

discrimination means for sequentially reading digital values detected by said digital value detection means for at least three times, and for discriminating whether the read digital value is showing a tendency to increase or a tendency to decrease; and control data output means for outputting first control data and second control data in accordance with the discrimination result by said discrimination means, said first control data indicating that said digital data shows a tendency to increase and said second control data indicating that said digital data shows a tendency to decrease.

20. An electronic musical instrument in accordance with claim 19, wherein the first control data supplied from said output means is used for altering the pitch designated by said pitch designation means to a higher pitch and for outputting particular effect sounds and the second control data supplied from said output means is used for altering the pitch designated by said pitch designation means to a lower pitch and for outputting second particular effect sounds.

* * * * *